US009669975B2

(12) United States Patent
Artz

(10) Patent No.: US 9,669,975 B2
(45) Date of Patent: Jun. 6, 2017

(54) MULTI-PURPOSE CAP AND DRYING STAND

(71) Applicant: Carson Artz, San Clemente, CA (US)

(72) Inventor: Carson Artz, San Clemente, CA (US)

( * ) Notice: Subject to any disclaimer, the term of this patent is extended or adjusted under 35 U.S.C. 154(b) by 13 days.

(21) Appl. No.: 14/552,327

(22) Filed: Nov. 24, 2014

(65) Prior Publication Data

US 2016/0145017 A1 May 26, 2016

(51) Int. Cl.
*B65D 51/24* (2006.01)
*B65D 41/02* (2006.01)

(52) U.S. Cl.
CPC ..... *B65D 51/249* (2013.01)

(58) Field of Classification Search
CPC ..... A47L 15/001; A47L 15/0013; A47L 15/0034; A47L 15/505; A47L 19/00; A47L 19/04; B65D 51/249
USPC ..... 215/228, 395, 386; 220/630
See application file for complete search history.

(56) References Cited

U.S. PATENT DOCUMENTS 2,419,040 A 4/1947 Stepanian
2,447,166 A * 8/1948 Daffer ..... B65D 47/068 215/228
2,990,080 A * 6/1961 Harris ..... A47G 23/0241 215/228
3,156,272 A * 11/1964 Indrunas ..... B65D 81/3205 141/286
3,317,069 A 5/1967 Chin
3,402,844 A 9/1968 Chin
4,101,044 A 7/1978 Paquette et al.
4,347,879 A * 9/1982 Blaser ..... B65D 71/502 141/364
4,723,671 A 2/1988 Mears
4,846,360 A 7/1989 Criste
5,373,953 A * 12/1994 Fenton ..... B65D 51/242 206/806
5,664,753 A 9/1997 Takei
5,950,698 A 9/1999 Cristea et al.
5,988,413 A * 11/1999 Nagel ..... B65D 50/045 215/216
5,992,662 A * 11/1999 Holt ..... B67C 9/00 141/319
RE37,566 E 3/2002 Cristea et al.
(Continued)

FOREIGN PATENT DOCUMENTS

AU 2003200259 2/2003
BE 868933 11/1978
(Continued)

OTHER PUBLICATIONS

Screen shot from Google image search for "inverted bottle drain cap liquid" found at https://www.google.com/search?q=inverted+bottle+drain+cap+liquid&client=firefox.
(Continued)

*Primary Examiner* — J. Gregory Pickett
*Assistant Examiner* — Niki M Eloshway
(74) *Attorney, Agent, or Firm* — Chernoff Vilhauer, LLP

(57) ABSTRACT

A cap for a container has two portions. The first portion attaches to and closes the mouth of the container. The second portion attaches to the mouth of the container to support the container in a mouth-down position that promotes draining and enables evaporation within the interior space of the container.

4 Claims, 4 Drawing Sheets

(56) References Cited

U.S. PATENT DOCUMENTS

| | | | | |
|---|---|---|---|---|
| 6,880,730 | B2 | 4/2005 | Fulwood | |
| 8,689,987 | B2 * | 4/2014 | Lewis | A61J 11/04 141/322 |
| 2007/0272329 | A1 * | 11/2007 | Favreau | A47G 23/0241 141/364 |
| 2009/0065377 | A1 * | 3/2009 | Olomi | B65D 41/26 206/217 |
| 2012/0298659 | A1 * | 11/2012 | Bogner | B65D 71/502 220/200 |
| 2014/0137424 | A1 * | 5/2014 | Yessin | F26B 25/18 34/104 |

FOREIGN PATENT DOCUMENTS

| | | |
|---|---|---|
| CA | 2830093 | 5/2014 |
| CN | 103832685 | 6/2014 |
| EP | 2735256 | 5/2014 |
| ES | 237191 U | 5/1979 |
| ES | 237191 Y | 11/1979 |
| FR | 2397992 | 2/1979 |
| GB | 2001301 | 1/1979 |
| JP | S5424182 | 2/1979 |
| WO | PCT/US06/61371 | 8/2007 |

OTHER PUBLICATIONS

Screen shot from "Clean Bottle" found at http://www.cleanbottle.com/.

* cited by examiner

MULTI-PURPOSE CAP AND DRYING STAND

BACKGROUND

The prevalence of reusable containers, or more specifically reusable beverage bottles, has steadily increased in recent years as consumers are more conscious about the environmental impact of disposable items. To clean most currently available reusable bottles, the cap and the bottle are washed and dried separately. Two problems arise with this process. The first is that it is frequently inconvenient to position the bottle in an inverted position to promote draining while also allowing circulating air to dry the inside of the bottle. If a bottle is merely balanced on its mouth upon a flat surface such as a counter, table or shelf, all ventilation is blocked. The second problem is that the bottle cap is separated from the bottle, either during drying or during storage, and often misplaced.

To avoid the potential loss of a bottle cap, a user often places a bottle cap on a still-moist bottle. Closing a bottle prior to drying can cause mildew, resulting in unpleasant smells and tastes that taint the flavor of future contents.

The prior art includes systems or holders which help to supports bottles in an inverted position. However, the prior art does not disclose a cap which both supports a bottle in a draining position and creates an air-tight seal. Further, the prior art does not solve the problems of either losing a cap or re-capping a bottle which is not completely dry. Once a bottle cap is misplaced, the bottle is useless as a device to carry fluids and is often discarded, defeating the goal of a reusable bottle.

The present invention seeks to solve these problems by combining the functionality of a bottle cap with a bottle stand which stays attached to the bottle during both drying and storage.

SUMMARY OF THE INVENTION

This invention is a multi-purpose container cap and stand with first and second features. The first feature provides a closure for the container. The second feature supports the container in a position that promotes draining and drying.

DETAILED DESCRIPTION OF PREFERRED EMBODIMENTS

Figure 1:
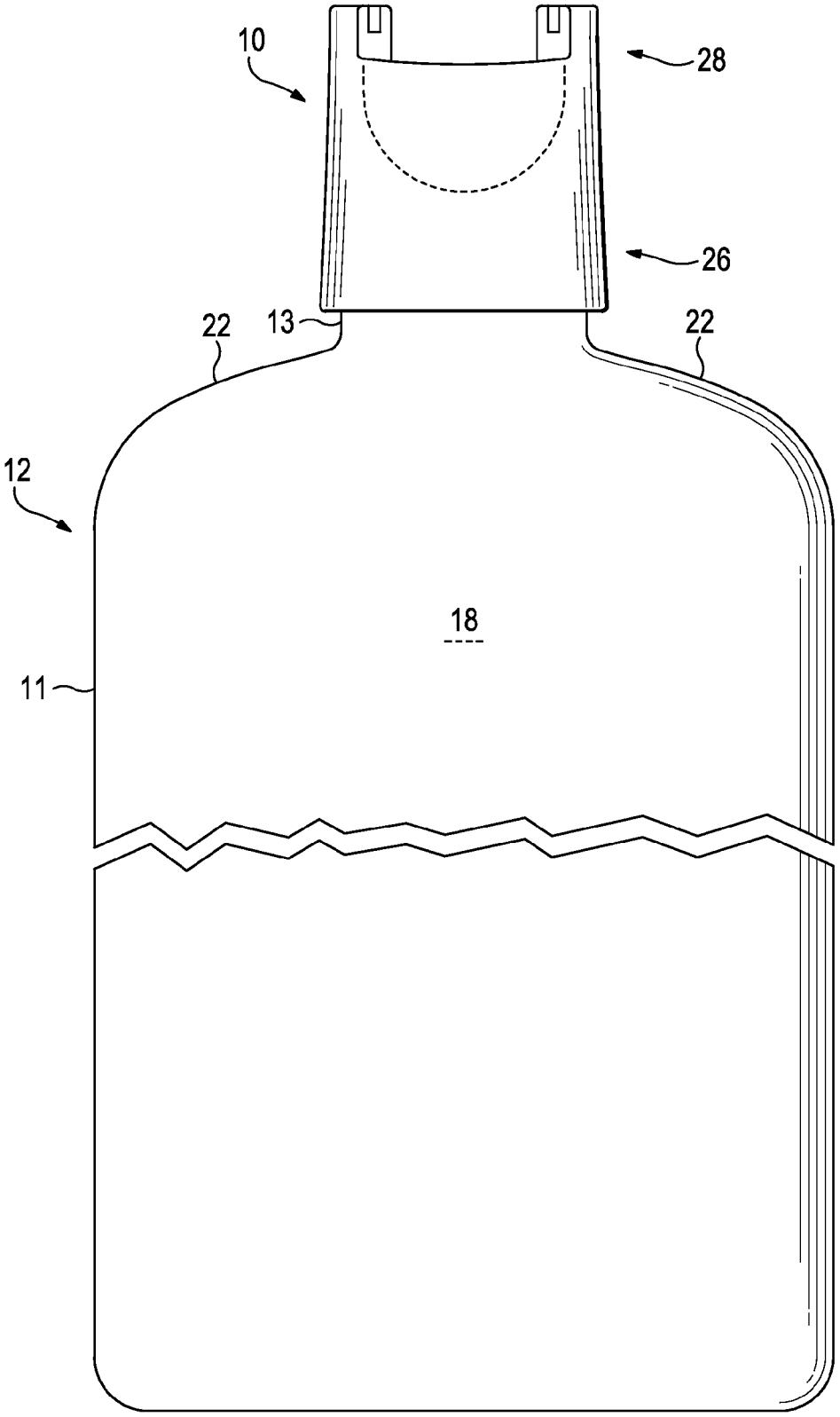
FIG. 1 is a side elevational view of a bottle and exemplary cap used as closure for the bottle.

Referring to the drawings which form a part of the disclosure herein, FIG. 1 shows a container cap 10 in use with a container 12. The exemplary container shown in FIGS. 1-3 includes a shell 11 enclosing an interior space 18. The exemplary container includes shoulder 22, and a neck 13. A mouth 14 defines an opening in the container. The mouth includes a rim 16. Threads 30 on the neck of the container proximate the mouth provides a means for engaging the cap.

The exemplary cap 10 shown in FIGS. 1-5 include a first portion or feature 26 and a second portion or feature 28. The first portion 26 of the cap includes threads 32 which provide means for engaging mating threads on container 12. The second portion of the cap 28 includes a supporting structure 20. The exemplary supporting structure has two protrusions 36, each with an arcuate indentation 34. The second portion also includes a reservoir 42 for collecting draining liquids.

Figure 2:
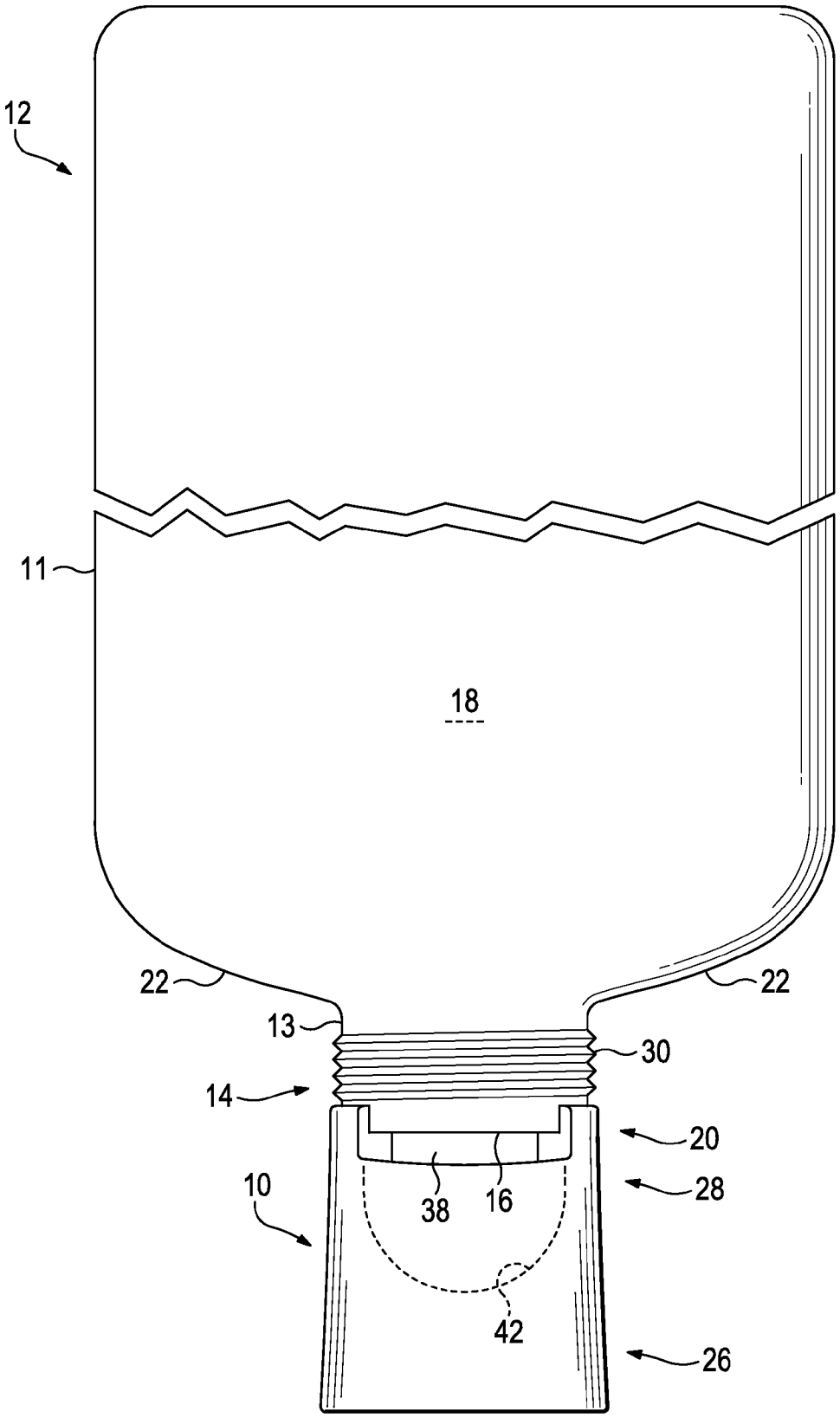
FIG. 2 is a side elevational view of the cap and bottle of FIG. 1 wherein the cap is supporting the bottle in an inverted position.
Figure 3:
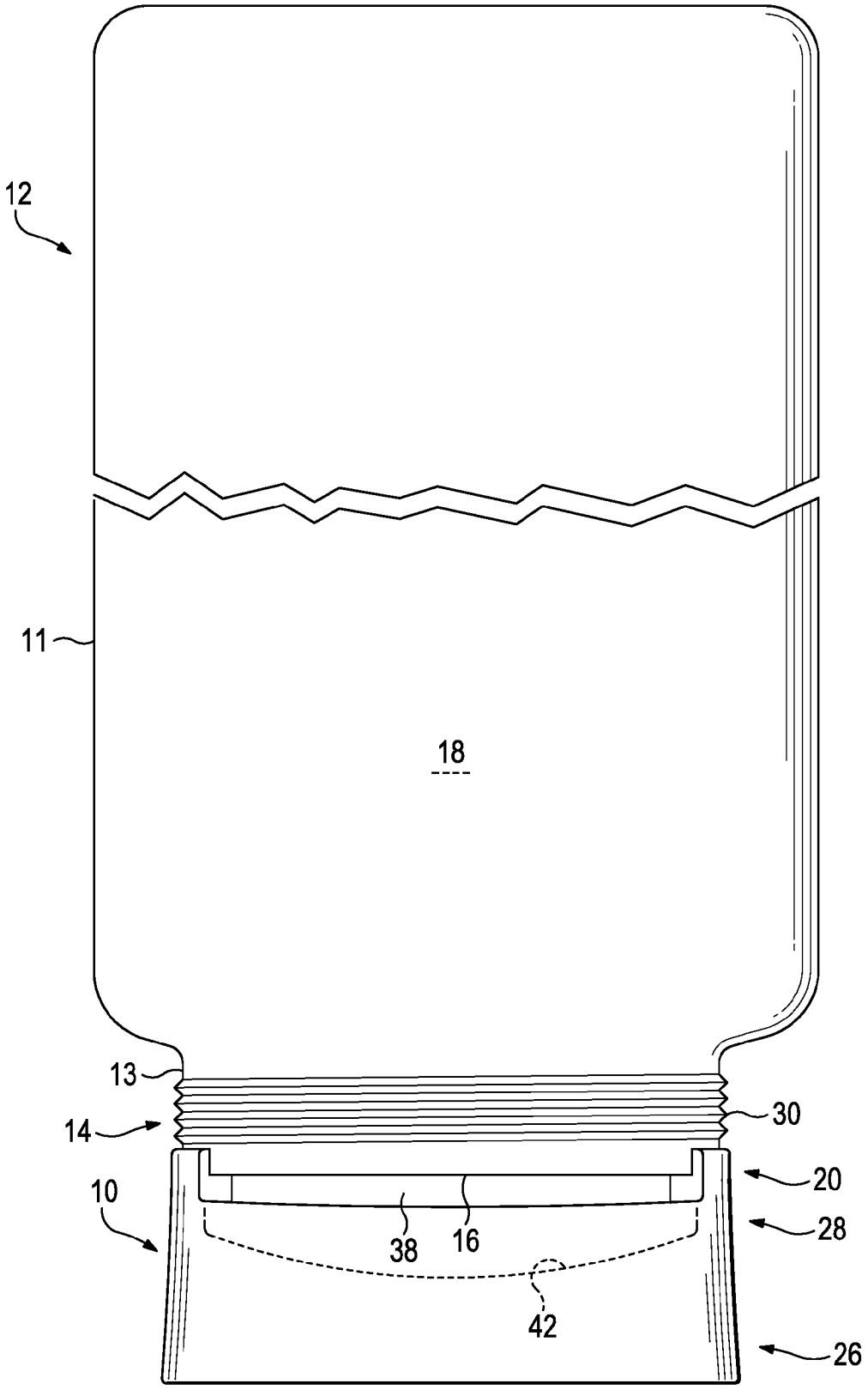
FIG. 3 is a partial side elevational view of an alternate embodiment of the cap and bottle in an inverted position.
Figure 4:
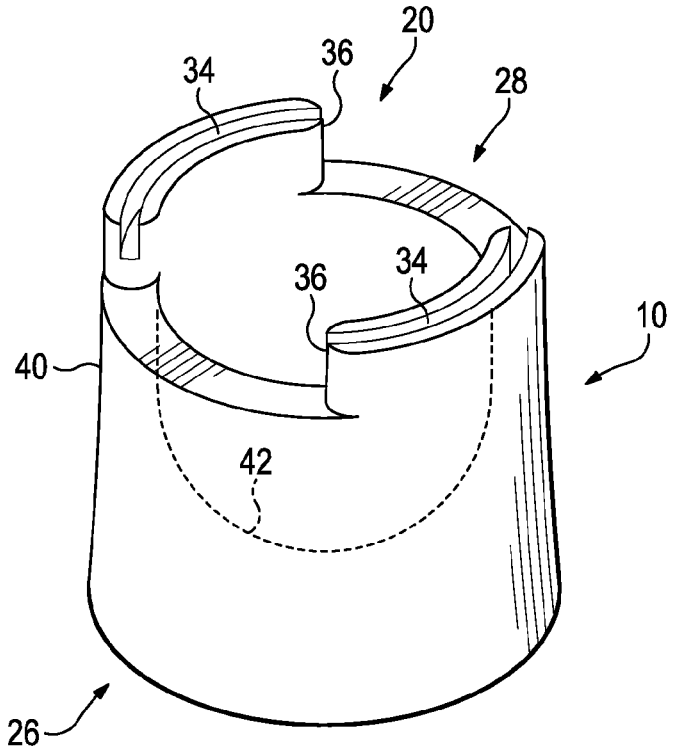
FIG. 4 is an isometric view of the cap of FIG. 1 positioned to hold a bottle in an inverted position.
Figure 5:
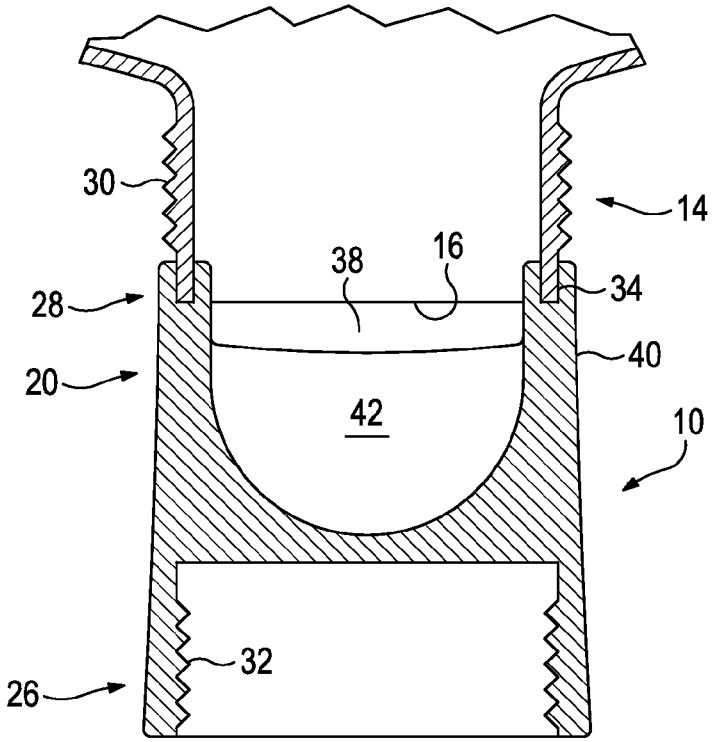
FIG. 5 is a partial sectional view of the cap and bottle shown in FIG. 2.

The cap 10 can be engaged with the container 12 in two positions: the first position shown in FIG. 1, with the first portion 26 of the cap engaged with the mouth 14 of the container, and the second position is shown in FIGS. 2, 3, and 5, with the second portion 28 of the cap engaged with the mouth of the container 12.

To engage first portion 26 of the cap 10 with the container 12 as shown in FIG. 1, the first portion of the cap, with threads 32, is placed in contact with the mouth 14 of the container. The cap and the container can then be fully secured together by engaging the respective threads 30 and 32 by screwing or twisting them together. The first portion can be disengaged and released from the container by twisting the cap in an opposite direction.

To engage the second portion 28 of the cap 10 with the container 12 in the second position as shown in FIGS. 2, 3, and 5, the rim 16 of the container mouth 14 is received in indentations 34 of the second portion. In the exemplary embodiment, the rim is pressed into the indentations to create a secure friction fit engagement between the container and the second portion. The engagement between the second portion and the container can be released by pulling and twisting the cap away from the container.

FIG. 1 shows the container 12 in an upright position, with the cap 10, in the position which fully closes and creates an airtight seal with the mouth 14 of the container. When the cap is used as a closure as shown in FIG. 1, the container can be carried and used, and any internally-held liquid is contained in the interior space 18.

FIG. 2 shows the cap 10 used as a bottle stand such that the second portion 28 of the cap is attached to the rim 16 of the mouth 14 of the container, and the container 12 is in a mouth-down position. In this second position, the cap can support the container in a draining position, enabling draining of fluid from the interior space 18, or retained in engagement with the container in storage. When in storage with the cap in the second position, air is permitted to circulate into the container to permit continued drying of the interior space, regardless of the position of the container.

As best seen in FIGS. 2-5, the second portion 28 of the cap 10 is configured to allow for air circulation through vents 38 in and out of the interior space 18 of the container. The vents are shown in the Figures as the space between the rim 16 and the cap created by the protrusions 36. In an alternate configuration, the second portion can be constructed without a protrusion and with a first, or only one, indentation extending partially or completely around the circumference of the second portion. This alternative configuration would still be configured to receive the rim of the container 12. In this configuration wherein the second portion does not include any protrusions, vents could be separately constructed through the wall 40 of the second portion.

In the exemplary embodiment, the second portion 28 of the cap 10 includes a reservoir 42 that is positioned to receive fluid that drains from out of the interior space 18 of the container 12 through the container mouth 14 while the container is supported in a draining position. The reservoir is best viewed in FIG. 5, which shows a sectional view of the cap 10, secured to the container mouth. In use, the fluid received by the reservoir can be emptied or left to evaporate.

The cap 10 can be configured to fit with any type of container 12 having a mouth 14 with a rim 16 and capable of holding fluid in an interior space 18. For example, in the container shown in FIG. 3, the mouth 14 and neck 13 are larger with respect to the shell 11 of the container than in FIG. 2.

Further, the second portion 28 of the cap 10 does not have to engage the mouth 14 of the container 12, any arrangement wherein the second portion of the cap engages the container to support it in a draining position and/or permit airflow to the inside of the container is within the scope of the invention.

Although the engagement means between the container 12 and first portion 26 of the cap 10 are mating threads, the invention is not limited to such a closure, and any means of airtight closure is within the scope of the invention. Also, even though the exemplary container and cap are shown with the threads 30, 32 on the outside of the container neck 13, and the inside of the cap, placing the threads on the inside of the neck and the outside of the cap is within the scope of the invention.

Regarding the second manner of use, in which the second portion 28 is attachable to the container mouth 14, the cap 10 may be specifically constructed to hold the container 12 in draining positions other than inverted so long as the position promotes draining of fluid from the interior space 18 of the container.

In the exemplary embodiment, the second portion of the cap 10 is shown opposite to the first portion 26 of the cap. The invention is not limited to this configuration. Any configuration wherein the first portion acts as a closure and the second portion 28 supports the container 12 in a draining position is within the scope of the invention.

What is claimed is:

1. A cap for a container having a mouth and capable of holding fluid in an interior space, said cap comprising:

(a) a first feature and a second feature;

(b) said first feature configured to close said mouth of said container;

(c) said second feature configured to support said container in a draining position that enables draining of said fluid from said interior space, and wherein said second feature includes a reservoir, positioned and shaped to hold fluid draining from said mouth when said cap supports said container in said draining position;

(d) said mouth of said container includes a rim, said second feature of said cap including a supporting structure to engage said rim and support said container in said draining position, wherein said supporting structure includes a first indentation for receiving said rim of said container to support said container in said draining position; and (e) wherein said second feature includes a first protrusion and said first indentation is located in said first protrusion.

2. The cap of claim 1, wherein said second feature allows passage of air to said interior space of said container when said cap supports said container in said draining position.

3. The cap of claim 1 wherein said container in said draining position is substantially inverted.

4. The cap of claim 1 wherein said first feature of said cap is adapted to form an airtight seal with said mouth of said container.

* * * * *